United States Patent [19]

Frazier et al.

[11] Patent Number: 4,935,998

[45] Date of Patent: Jun. 26, 1990

[54] FASTENER CLIP FOR FURNITURE RAILS

[75] Inventors: Thomas A. Frazier, Wilmette; Kenneth C. Pearson; Wayne A. Bechtoldt, both of Glenview, all of Ill.

[73] Assignee: Hartco Company, Ill.

[21] Appl. No.: 370,032

[22] Filed: Jun. 22, 1989

[51] Int. Cl.[5] ..... A47C 23/00

[52] U.S. Cl. ..... 24/350; 24/347; 24/380; 411/466

[58] Field of Search ..... 24/350, 347, 380, 295; 411/456, 466, 467, 468; 5/259 B

[56] References Cited

U.S. PATENT DOCUMENTS

| | | | |
|---|---|---|---|
| 777,879 | 12/1904 | Blum | 24/380 |
| 831,179 | 9/1906 | McDonagh | 411/466 |
| 880,757 | 3/1908 | Rugg | 24/380 |
| 2,058,020 | 10/1936 | Jaffe | 411/456 |
| 2,282,631 | 5/1942 | Winship | 411/466 |
| 3,447,823 | 6/1969 | Gregoire | 411/466 |
| 3,773,310 | 11/1973 | Crosby | 5/259 B |
| 4,062,087 | 12/1977 | Lingle | 24/347 |
| 4,454,636 | 6/1984 | Pearson | 24/347 |

FOREIGN PATENT DOCUMENTS

| | | | |
|---|---|---|---|
| 302765 | 12/1928 | United Kingdom | 411/456 |

*Primary Examiner*—Victor N. Sakran

*Attorney, Agent, or Firm*—Wallenstein, Wagner & Hattis, Ltd.

[57] ABSTRACT

A fastener clip for securing an end bar of a furniture spring to a rail of a framework of an article of furniture, and a method of inserting the fastener clip into the rail, are disclosed.

3 Claims, 3 Drawing Sheets

FIG. 1
PRIOR ART
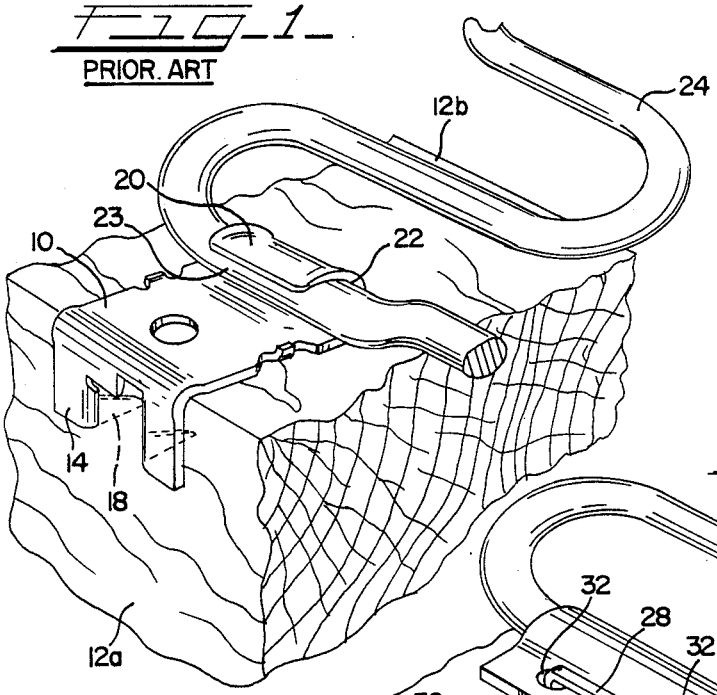
FIG. 2
PRIOR ART
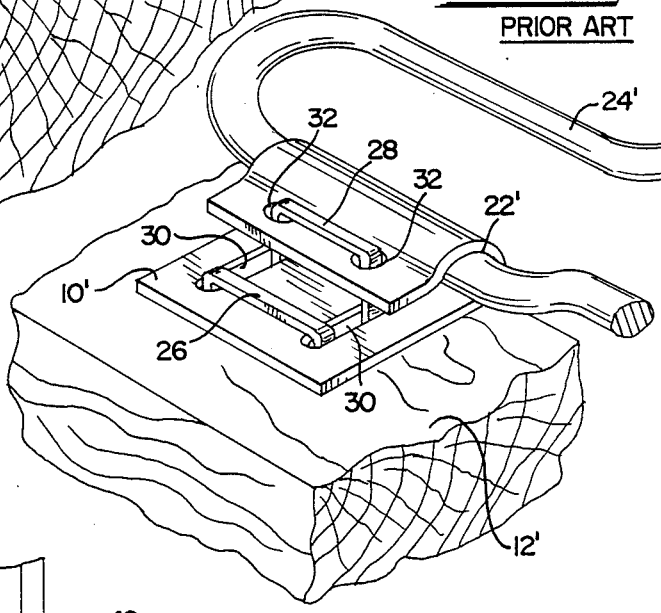
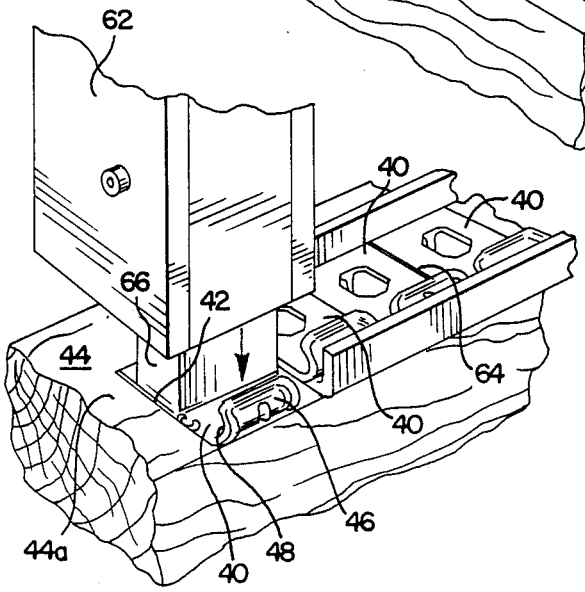
FIG. 3

FASTENER CLIP FOR FURNITURE RAILS

TECHNICAL FIELD

This invention relates to a fastener clip for securing a furniture spring to a furniture rail of a framework of an article of furniture, and more particularly, to a fastener clip adapted to be disposed on a single surface of the furniture rail in a single operation.

BACKGROUND PRIOR ART

Fastener clips in general are well known for securing furniture springs to furniture rails forming the framework of an article of furniture.

The framework typically includes four elongated furniture rails joined end to end as a rectangle. Corresponding fastener clips are secured by means of staples or depending legs to respective, opposing ones of the rails. The fastener clips typically terminate at one end with a generally curved spring receiving portion. Opposing end bars of a bowed sinuous furniture spring extend between the opposing rails and are secured to the fastener clips within the spring receiving portion. The spring presents a generally inwardly directed spring force on each of the respective opposing rails via the fastener clips.

According to one prior art design, the fastener clip is generally J-shaped having a curved portion defining a spring receiving portion and joining a long leg segment to a short leg segment. The long leg is first manually stapled to the rail, the respective spring end bar is then disposed in the spring receiving portion, and the short leg is finally stapled over the spring end bar to the rail. Thus two manual stapling operations are required to secure the fastener clip to the rail.

Another fastener clip is disclosed in U.S. Pat. No. 3,323,183 to Sterner entitled "Upholstery Spring Attachment Clip For Furniture". This fastener clip incorporates a base portion having a circular hole, a pair of securing prongs extending from a rear end of the base portion, and a re-entrant bend integral with a front end of the base portion. The re-entrant bend terminates with an overlying portion having a pointed prong. The re-entrant bend and overlying portion define a spring receiving portion. The pair of securing prongs are first inserted into the rail, the spring end bar is then inserted in the spring receiving portion and finally the pointed prong is inserted through the circular hole and into the rail. Again a two step operation is required to fully secure this fastener clip to the rail. In addition, this fastener clip results in significant waste of clip material, because unused clip material is removed to form the pair of securing prongs and the pointed prong.

According to another prior art design described in commonly assigned U.S. Pat. No. 4,454,636 to Pearson, entitled "Spring Fastener Clip for Wooden Furniture Rails", a fastener clip ("the '636 fastener clip") has been provided with a depending flange opposite a spring receiving portion for attachably abutting a rear surface of the rail. The '636 fastener clip can be inserted into the rail in a single operation.

As indicated above, the spring presents a generally inwardly directed spring force on each of the opposing rails via the fastener clips. Typically the rails have been rectangular in end-view, defining a first pair of relatively narrow surfaces and a second pair relatively wide surfaces. Traditionally the rail has been oriented such that the clip is mounted on one of the narrow surfaces, causing the spring force to be applied in the direction of the narrow, and hence weakest, dimension of the rail. Thus the rail must be dimensioned sufficiently to withstand the spring force without bowing.

In order to reduce the quantity of wood required in manufacturing the rail, some have rotated the rail 90° such that the fastener clip is mounted on one of the wide surfaces. Accordingly, the spring force is applied in the direction of the relatively wide, and hence stronger, dimension of the rail. Thus the wider dimension of the rail can be reduced. However the fastener clip will still be mounted on a surface of the rail which is wider than when the fastener clip was mounted on the narrow surface.

For applications where the fastener clip is mounted on one of the narrow surfaces of the rail, the above '636 fastener clip is quite satisfactory. However because the '636 fastener clip is necessarily positioned at the rear of the rail, if the rail is rotated and the '636 fastener clip is mounted on one of the relatively wide surfaces, a longer spring is required to reach the fastener clip. A longer spring adds to the material cost of the spring and, further, it can possibly interfere with the front of the rail. To avoid the necessity of a longer spring, the spring receiving portion of the fastener clip can be inwardly extended, but this requires additional fastener clip material, which causes the fastener clip to be more expensive.

The present invention is provided to solve these and other problems.

SUMMARY OF THE INVENTION

It is an object of the invention to provide a fastener clip for securing an end of a furniture spring to a furniture rail, as of wood, of a framework of an article of furniture. It is a further object of the invention to provide a method of inserting the fastener clip into the furniture rail.

According to one aspect of the invention, the fastener clip comprises a base portion having a front section and a rear section. The base portion is adapted to overlie a surface of the furniture rail. The fastener clip further comprises a reverse curved portion integrally joined to the front section of the base portion, the reverse curved portion defining a spring receiving portion adapted for receiving the end bar of the upholstery spring. The fastener still further comprises first and second front legs and a rear leg integrally depending from the base portion and adapted for insertion into the furniture rail. The rear leg is disposed between the first and second front legs and the rear section of the base portion.

It is comprehended that the rear leg is serrated to prevent its removal from the rail as a result of a torque applied to the fastener clip by the spring.

It is further comprehended that each of the first and second front legs are disposed in a mutually non-parallel relationship so that they cross the grain of the rail to minimize the possibility of the wood splitting.

According to another aspect of the invention, a method is provided for inserting a plurality of fastener clips into the furniture rail.

The method includes the steps of providing a plurality of fastener clips according to the first aspect of the invention, providing a machine having a hammer head, sequentially advancing each of the fastener clips between the hammer head and the furniture rail, and selectively actuating the hammer head to hammer the fastener clips into the furniture rail at predetermined locations along the furniture rail.

Other features and advantages of the invention will be apparent from the following specification taken in conjunction with the following drawings.

BRIEF DESCRIPTION OF DRAWINGS

FIG. 1 is a perspective view of one prior art fastener clip secured to a furniture rail;

FIG. 2 is a perspective view of another prior art fastener clip secured to a furniture rail;

FIG. 3 is a view of a fastener clip according to the present invention being inserted into a furniture rail;

DETAILED DESCRIPTION

Figure 4:
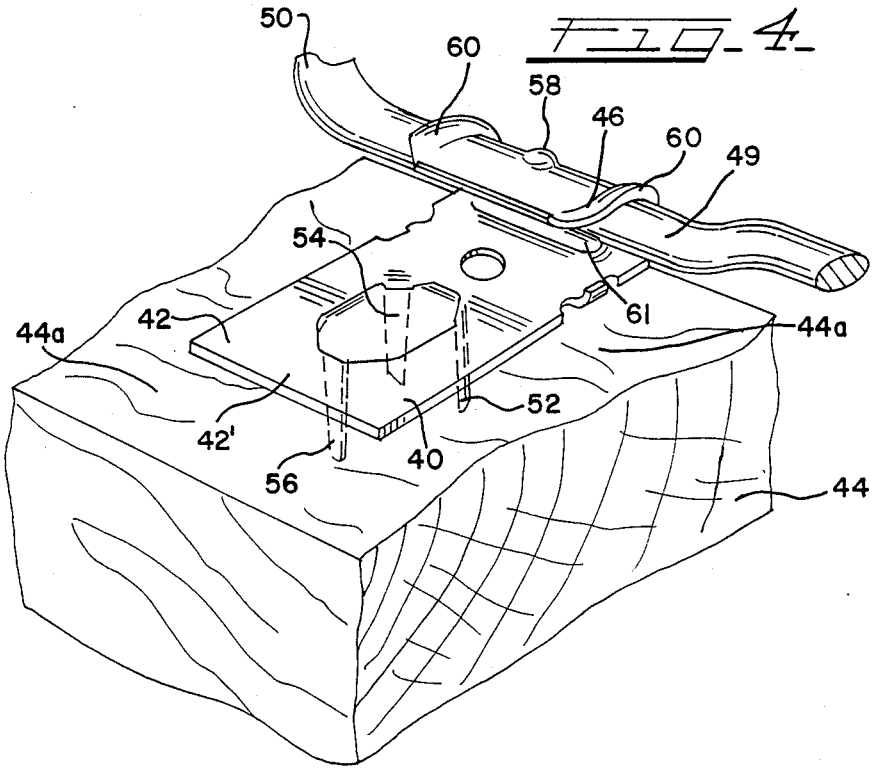
FIG. 4 is a perspective view of the fastener clip of FIG. 3 inserted into a furniture rail and retaining a spring end bar.
Figure 5:
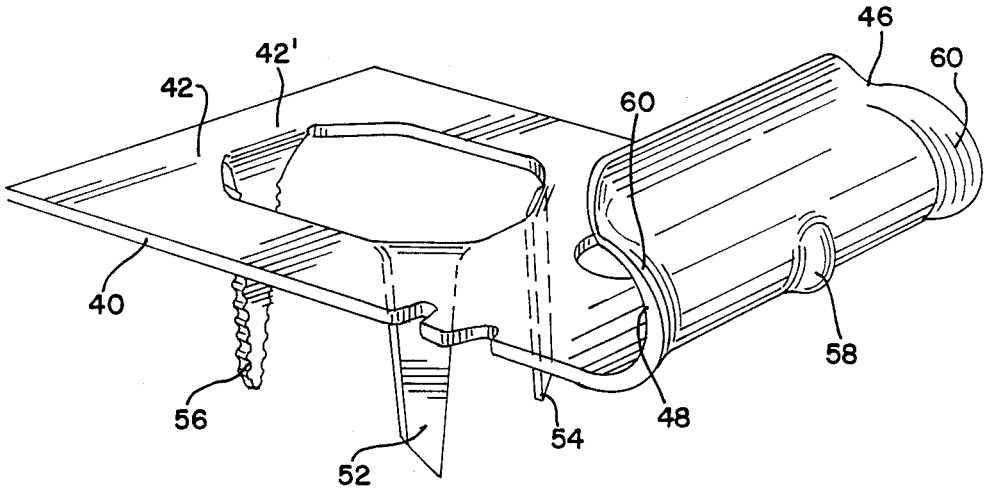
FIG. 5 is a perspective view of the fastener clip of FIG. 3.
Figure 6:
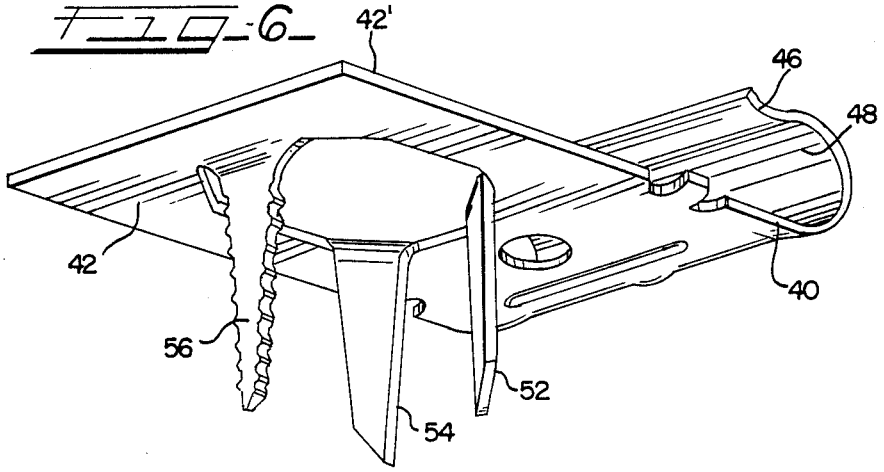
FIG. 6 is a perspective view of the fastener clip of FIG. 3 as viewed generally from its underside.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

In the following discussion, both with respect to prior art fastener clips as well as the furniture clip according to the invention, the furniture rail is described for clarity as used for construction of a seat of a piece of furniture, i.e., a horizontal framework. It should be understood that the invention is equally applicable for constructing a vertical framework for a back of a piece of furniture, or such other uses of fastener clips as are well known in the art.

Referring to FIG. 1, a first prior art fastener clip 10 is illustrated inserted in a furniture rail 12. The furniture rail 12 is typically an elongated strip of wood rectangular in end view. This first prior art fastener clip 10 is as illustrated in U.S. Pat. No. 4,454,636, issued to Pearson and entitled "Spring Fastener Clip for Wooden Furniture Rails".

The first prior art fastener clip 10 includes a depending flange 14 having a pair of spaced wood penetrating anchors or prongs 18 which are inserted into an outwardly directed surface 12*a* of the furniture rail 12.

The first prior art fastener clip 10 terminates with a lip 20 defining a spring receiving portion 22 for securely receiving an end bar 23 of a furniture spring 24.

Because the first prior art fastener clip 10 is secured to the outwardly directed surface 12*a* of the furniture rail 12, the spring receiving portion 22 tends to be toward the outward portion of the furniture rail 12. Accordingly, when the furniture spring 24 downwardly flexes in use, the spring 24 can interfere with an upper front surface 12*b* of the furniture rail 12. In addition, the furniture spring 24 must be slightly longer in order to reach the spring receiving portion 22.

One way to eliminate this interference problem is to make the furniture rail 12 narrower. However, as discussed above, the current trend in furniture manufacturing is to orient the furniture rail 12 such that it is in fact wider, while reducing its height.

Another way to eliminate this interference problem is by elongating the first fastener clip 12, thereby inwardly extending the first prior art fastener clip 10; however, this results in a more expensive fastener clip 10 because of the additional material required.

A second prior art fastener clip 10′ is illustrated in FIG. 2 secured to a furniture rail 12′. The second prior art fastener clip 10′ is generally J-shaped defining a spring receiving portion 22′ and is secured to the furniture rail 12′ by first and second staples 26, 28. The second prior art fastener 10′ includes a pair of spaced slots 30. The second prior art fastener clip 10′ is secured to the furniture rail 12′ by first inserting the first staple 26 through the slots 30 and into the top surface of the furniture rail 12′. An end bar 23′ of a spring 24′ is inserted in the spring receiving portion 22′. The second staple 28 is inserted through a pair of spaced holes 32, then through the slots 30 and ultimately into the furniture rail 12′. The second staple 28 pulls the second prior art fastener clip 10′ tight against the end bar 23′. Thus two stapling operations are required to secure the end bar 23′ into the spring receiving portion 22′ and to secure the second prior art fastener clip 10′ to the furniture rail 12′.

A fastener clip 40 according to the invention is illustrated in FIGS. 3–8. The fastener clip 40 includes a base portion 42 adapted to overlie an upper surface 44*a* of a furniture rail 44. The fastener clip 40 further includes a reverse curved portion 46 integrally joined to a front section of the base portion 42. The reversed curved portion 46 defines a spring receiving portion 48 adapted for receiving an end bar 49 of a furniture spring 50.

The fastener clip 40 further includes first and second front legs 52, 54 integrally depending from the base portion 42 and adapted for insertion into the upper surface 44*a* of the furniture rail 44. The fastener clip 40 further includes a serrated leg 56 disposed between the first and second front legs 52, 54 and a rear section 42*r* of the base portion 42, also integrally dependent from the base portion 42 and adapted for insertion into the top surface 44*a* of the rail 44. The first and second front legs 52, 54 and the serrated leg 56 are struck from the bodY of the base portion 42, eliminating any wasted clip material.

Figure 8:
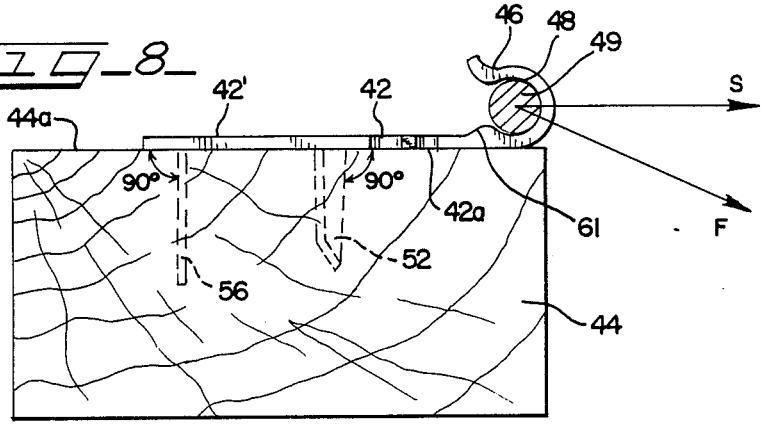
FIG. 8 is a side elevational view of the fastener clip of FIG. 3 inserted into a furniture rail.

As illustrated in FIG. 8, the first and second front legs 52, 54 and the serrated rear leg 56 are disposed at an angle of 90° from an under-surface 42*a* of the fastener clip base portion 42.

Figure 7:
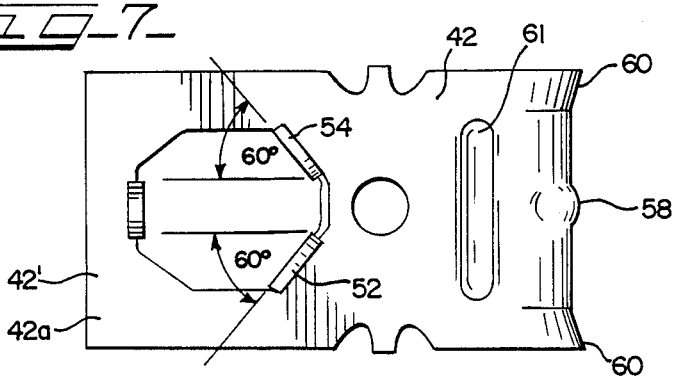
FIG. 7 is a bottom plan view of the fastener clip of FIG. 3.

Referring to FIG. 7, the first and second front legs 52, 54, respectively, are disposed at an angle of 60° with the longitudinal axis of the fastener clip 40. These front legs 52, 54 are so disposed so that they cut at an angle with respect to the grain of the furniture rail 44 when inserted therein, thereby minimizing splitting of the rail 44.

The fastener clip 40 further includes a centrally formed reinforcing rib 58 to reinforce the reverse curved portion 46. In addition, the reverse curved portion 46 includes outward flares 60 which serve to prevent edges of the reverse curved portion 46 from cutting into the furniture spring 50.

A detent 61 maintains the end bar 49 of the spring 50 within the reverse curved portion 46.

Referring to FIG. 8, the spring 50 applies a substantially horizontal spring-pull, or shear, force S as well as a generally downward load force F. The first and second front legs 52, 54 provide holding power to oppose the shear force S. The serrations of the rear leg 56 resist a levering or prying action on the fastener clip 40 resulting from the downward load force F.

Referring now to FIG. 3, a machine 62 for inserting the fastener clip 40 into the furniture rail 44 is illustrated. A plurality of the fastener clips 40 are manufactured as a continuous strip 64, which can be wound as a coil (not shown). The coil is unwound as the strip 64 is advanced toward a hammer head 66 such that individual ones of the fastener clips 40 are sequentially positioned between the hammer 66 and the furniture rail 44. A sensor (not shown) actuates the machine 62, causing the hammer head 66 to hammer the fastener clip 40 into the furniture rail 44 in a single hammering operation.

Thus, it can be seen that a fastener clip has been provided which can be inserted substantially at an inward portion of an upper surface of a rail in a single operation, thereby permitting its use on substantially wide furniture rails, though requiring no extra material and preventing interference of the spring with the furniture rail.

It will be understood that the invention may be embodied in other specific forms without departing from the spirit or central characteristics thereof. The present embodiment, therefore, is to be considered in all respects as illustrative and not restrictive, and the invention is not to be limited to the details given herein.

We claim:

1. A one-piece fastener clip for securing an end bar of a furniture spring to a rail of a framework of an article of furniture, said fastener clip comprising:

a planar base portion having a front section and a rear section, said base portion adapted to overlie an upper surface of said rail;

a reverse curved portion integrally joined to said front section of said base portion, said reverse curved portion defining a spring receiving portion adapted for receiving said end bar of said furniture spring;

first and second front legs integrally depending substantially perpendicularly from said base portion and adapted for insertion into said rail; and a serrated rear leg integrally depending substantially perpendicularly from said base portion in substantial parallel relationship with said first and second front legs and adapted for insertion into said rail, said rear leg disposed between said first and second front legs and said rear section of said base portion.

2. The fastener clip of claim 1 wherein said first and second front legs define respective first and second transverse axes and said first and second transverse axes are disposed in a non-parallel relationship.

3. The fastener clip of claim 1 wherein said first and second front legs are disposed at an angle of 60° relative to a longitudinal axis of said fastener clip.

* * * * *